US008622066B2

(12) United States Patent
Dolsby et al.

(10) Patent No.: US 8,622,066 B2
(45) Date of Patent: Jan. 7, 2014

(54) PORTABLE EXPANDABLE SHELTER

(75) Inventors: Craig G. Dolsby, Spokane, WA (US); Andrew N. Barrett, Coeur d' Alene, ID (US); Doug W. Combs, Spokane, WA (US)

(73) Assignee: Berg Companies, Inc., Spokane, WA (US)

( * ) Notice: Subject to any disclaimer, the term of this patent is extended or adjusted under 35 U.S.C. 154(b) by 0 days.

(21) Appl. No.: 12/870,646

(22) Filed: Aug. 27, 2010

(65) Prior Publication Data

US 2011/0132421 A1 Jun. 9, 2011

Related U.S. Application Data

(60) Provisional application No. 61/285,089, filed on Dec. 9, 2009.

(51) Int. Cl.
*E04H 15/48* (2006.01)

(52) U.S. Cl.
USPC ..... 135/143; 52/64

(58) Field of Classification Search
USPC ..... 135/143, 153, 155; 52/69, 79.5
See application file for complete search history.

(56) References Cited

U.S. PATENT DOCUMENTS

| | | | | |
|---|---|---|---|---|
| 2,167,557 | A * | 7/1939 | Stout | 52/69 |
| 2,765,499 | A * | 10/1956 | Couse | 52/66 |
| 3,445,134 | A * | 5/1969 | Beck, Jr. et al. | 296/173 |
| 5,417,468 | A * | 5/1995 | Baumgartner et al. | 296/162 |
| 5,761,854 | A | 6/1998 | Johnson et al. | |
| 6,223,479 | B1 * | 5/2001 | Stockli | 52/68 |
| 7,017,975 | B2 * | 3/2006 | Parmer | 296/157 |
| 7,117,645 | B2 * | 10/2006 | Bzorgi | 52/79.5 |
| 7,418,802 | B2 | 9/2008 | Sarine et al. | |
| 7,658,037 | B2 * | 2/2010 | Bucher et al. | 52/67 |
| 7,874,107 | B1 * | 1/2011 | Medley et al. | 52/79.5 |
| 7,882,659 | B2 * | 2/2011 | Gyory et al. | 52/79.5 |
| 2006/0254159 | A1 * | 11/2006 | Trautman et al. | 52/64 |
| 2008/0149156 | A1 * | 6/2008 | Serden et al. | 135/97 |
| 2009/0217600 | A1 * | 9/2009 | De Azambuja | 52/79.5 |
| 2010/0018131 | A1 * | 1/2010 | Green | 52/79.5 |
| 2011/0023925 | A1 * | 2/2011 | Johnson et al. | 135/139 |

* cited by examiner

*Primary Examiner* — Noah Chandler Hawk
(74) *Attorney, Agent, or Firm* — Lee & Hayes, PLLC

(57) ABSTRACT

In one example, a portable expandable shelter includes an enclosure with one or more movable portions such as a side or end, and further includes a foldable frame configured and arranged for operation in unison with movement of the movable portion of the enclosure. This example of the portable expandable shelter also includes a cover that encloses at least a portion of a space defined by the movable portion and the foldable frame.

25 Claims, 13 Drawing Sheets

PORTABLE EXPANDABLE SHELTER

RELATED APPLICATIONS

This application hereby claims the benefit of U.S. Provisional Patent Application Ser. No. 61/285,089, entitled PORTABLE EXPANDABLE SHELTER, filed Dec. 9, 2009, and incorporated herein in its entirety by this reference.

BACKGROUND

Various portable shelters have been developed that are intended to be transported to a desired site and then set up for use at the site. When the portable shelter is no longer needed, it can be reconfigured in a way that may make it more suitable for transportation to another location. Due to their design and construction however, at least some of these portable shelters may require a significant amount of time and labor in order to properly set the shelter up for use, and to reconfigure the portable shelter for transportation when the shelter is no longer needed. At least some of these portable shelters may include various ancillary components that must be assembled and/or installed to enable set up of the portable shelter, and disassembly of such components when the shelter is being prepared for transportation. Yet other portable shelters may be configured so that, whether ready for use or ready for transportation, all the walls of the portable shelter are rigid. Configurations such as these may result in a portable shelter of significant weight that may not be well suited for some applications.

BRIEF DESCRIPTION OF THE DRAWINGS

To further clarify aspects of some example embodiments, a more particular description of such example embodiments will be rendered by reference to the appended drawings. It is appreciated that these drawings disclose only example embodiments of the invention and are therefore not to be considered limiting of its scope. The example embodiments will be described and explained with additional specificity and detail through the use of the accompanying drawings in which.

DETAILED DESCRIPTION

Figure 1:
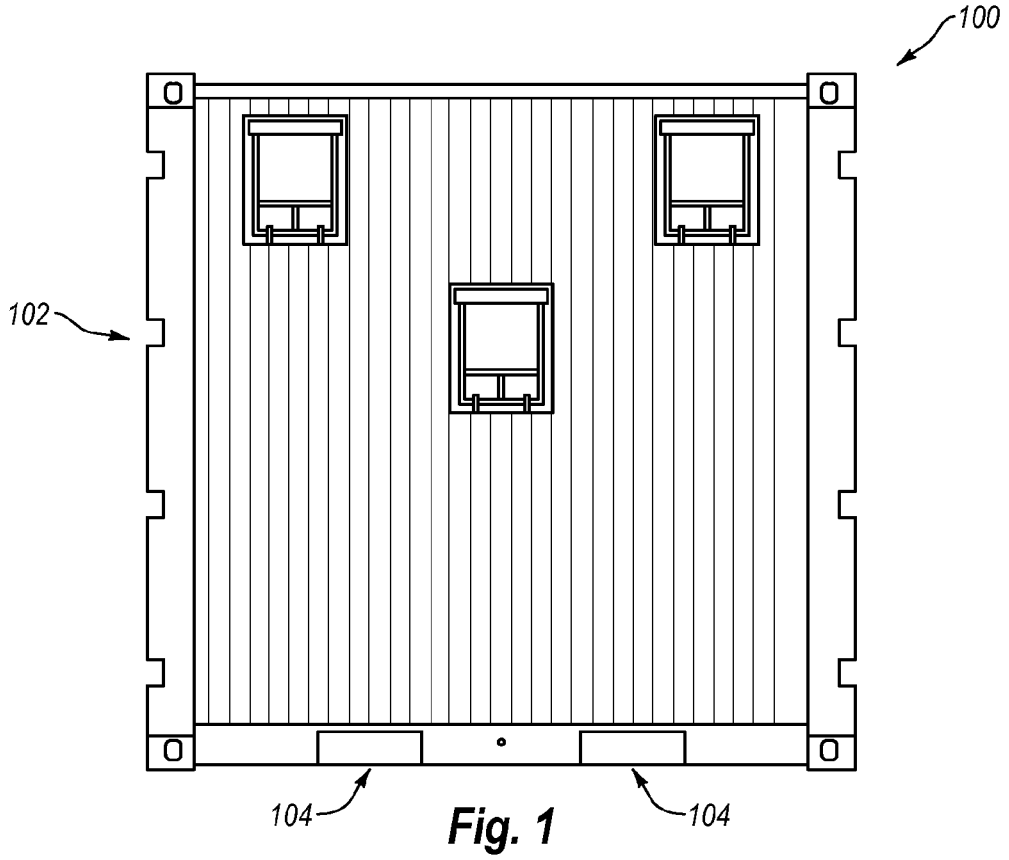
FIG. 1 is a side view of an example portable expandable shelter (PES)

In general, embodiments within the scope of this disclosure concern portable expandable shelters, at least some of which may include an enclosure with one or more movable sides and/or ends, and which may further include a foldable frame configured and arranged for operation in unison with movement of one or more sides or ends of the enclosure. Such embodiments may also include a cover that encloses at least a portion of a space defined by a movable portion of the enclosure and a foldable frame. Other embodiments within the scope of this disclosure may include additional, or alternative, elements. Examples of some more specific embodiments are disclosed in the figures.

General Aspects of Some Example Embodiments

The portable expandable shelters ('PES') disclosed herein are suited for a wide variety of uses in a wide variety of environments. Thus, the example aspects disclosed below may be combined in any suitable fashion to provide a desired portable expandable shelter. Moreover, the overall size of PES embodiments disclosed herein may be selected based upon a variety of considerations and, accordingly, the scope of the invention is not limited to any particular size(s) or configuration(s) of PES. Thus, the particular PES embodiments disclosed herein are presented only by way of example.

At least some of the PES embodiments disclosed herein may be configured and outfitted to suit various commercial, industrial, military, or other, uses. Some specific examples of such uses include, but are not limited to, field offices, field hospitals, decontamination stations, jails/brigs, holding cells, isolation wards, command posts, field morgues, communications centers, camps, laboratories and schools. As well, the PES can be configured and outfitted for use in virtually any physical or climatic environments, including, but not limited to, desert environments, extreme cold environments, and marine environments.

With reference to some example configurations and outfittings, the exterior of the PES can be painted with camouflage or other paint scheme suited to the anticipated environment and/or application in which the expandable portable shelter will be used. Exterior treatments other than paint, or in addition to paint, can likewise be employed. In some embodiments, one or more of the exterior surfaces of the PES may, for example, be substantially smooth. In other embodiments, one or more of the exterior surfaces may, for example, be corrugated. More generally, any exterior surface configuration may be employed, and various types of exterior surface configurations may be combined in a single embodiment so that, for example, a single PES may include both corrugated and smooth exterior surface configurations.

Further, a PES may include, for example, one or more of communications systems and equipment, plumbing including toilets, hot and cold water, vents and drainage systems, security systems, lighting, locks, climate control systems and equipment such as heaters, ventilators, fans, and air conditioners, and various types of medical equipment and facilities including diagnostic equipment, treatment equipment, and surgical equipment. As well, a PES may include one or more of suitable floor, wall and ceiling coverings, thermal insulation, sound insulation, other insulation, waterproofing treatment, armor, electromagnetic interference (EMI) shielding, and radiation shielding. Additionally, a PES may include, as appropriate, one or more of shelves, lockers, beds, desks, chairs, operating tables, windows and doors. Finally, and more generally, a PES may include any combination of the various outfittings and configuration elements disclosed herein.

Particular Aspects of Some Example Embodiments

At least some example embodiments conform, in whole or in part, to the shipping container configurations established by the ISO (International Organization for Standardization) standards. In one particular example then, an enclosure may have dimensions of either 6.1 m. (20 feet) or 12.2 m. (40 feet) in length and 2.44 m. (8 feet) in width and 2.6 m. (8.5 feet) or 2.9 m. (9.5 feet) in height. The width dimension may be as great as 3.05 m. (10 feet). The ISO and related standards may be found in publications such as ISO 1161 Series 1 Freight containers—corner fitting—specification; ISO 1496-1 Series 1 freight containers—Specification and testing—Part 1: General cargo containers for general purposes; ISO standards 9000 through 9004—quality standards; International Union of Railways (U.I.C.); Transport International des Routiers (T.I.R.); and, Convention for Safe Containers (C.S.C.), all of which are incorporated herein in their respective entireties by this reference.

As suggested above, the aforementioned configurations are simply illustrative examples and a PES may, more generally, be configured with any desired dimensions consistent with the purpose(s) for which that PES may be intended. By way of illustration, the enclosures of some example embodiments of a PES may be greater than about 20 feet long but less than about 40 feet long. The enclosures of yet other example embodiments of a PES may be less than about 20 feet long. In still further examples, the enclosure of a PES may be greater than about 40 feet long.

Consistent with the foregoing, and as suggested below in the discussion of the TRICON, it is also contemplated that a variety of PES enclosures with lengths less than ISO container lengths, such as the 20 feet ISO container length for example, may be employed. By way of example, the TRICON refers to a PES whose enclosure has a length of about one third the length of a 20 foot container, that is, a length of about 6.6 feet. Correspondingly, a BICON refers to a PES whose enclosure has a length of about half the length of a 20 foot container, that is, a length of about 10 feet. Finally, a QUADCON refers to a PES whose enclosure has length that is about one quarter the length of a 20 foot container, that is, a length of about 5 feet. Again, however, these are simply example enclosure lengths, and the scope of the invention is not limited to these examples.

Turning now to the figures, details are provided concerning various example embodiments. In general, the embodiments disclosed in the figures are presented by way of example. Thus, the figures should not be considered as constraining the scope of the invention in any way. In fact, the components disclosed in the figures may be combined as desired to create a PES having a particular configuration.

With particular reference first to FIG. 1, an example embodiment of a PES, denoted as PES 100, is disclosed that includes an enclosure 102. As noted above, a PES whose enclosure 102 has a length that is about one third the length of a 20 foot container is referred to herein as a TRICON. In alternative embodiments, the PES 100 may be implemented as a BICON, QUADCON, or other configuration.

The enclosure 102 may, consistent with ISO and/or other standards, include structural features 104 such as slots or other openings that enable the enclosure 102 to be readily transported by forklift, crane, or helicopter, for example. One or more portions of the enclosure 102 may be made out of a variety of materials including one or more of metal, composites such as glass composites or carbon composites for example, fabric, plastic, wood, rubber, and fiberglass. Moreover, different portions of the enclosure may be made of different materials and/or different combinations of materials, examples of which include the aforementioned materials. The various materials employed in the construction of the enclosure 102 may include both rigid materials and non-rigid materials.

The TRICON, BICON and QUADCON PES configurations, for example, may be particularly useful in certain applications inasmuch as the smaller size of those PES configurations, relative to a 40 foot long freight container for example, enables the PES to be readily transported and airlifted. For example, such PES configurations may be well suited for remote and rugged environments that could present a significant challenge to the transportation and use of a relatively larger shelter, such as a shelter whose size is comparable to a full sized freight container.

As the foregoing makes clear, one useful aspect of some embodiments is that multiple PESs, of any of the BICON, TRICON, QUADCON, or other, configurations, can be removably connected to each other in any desired combination. That is, different PES configurations can be connected together to form a desired combination so that, by way of example, one combination might include a BICON connected to a QUADCON. At least some of the PES combinations are dimensioned so that they can then be transported through container channels using standardized carriers such as trucks, ships, and rail cars. The PESs can also be transported as individual units. This approach may be particularly desirable in some instances as the relatively small size of some of the PESs lends a degree of flexibility in terms of the various ways in which such PESs may be transported. At least some embodiments of the PES are sized and configured to be suited for transportation as air cargo by airplanes or helicopters.

Figure 2:
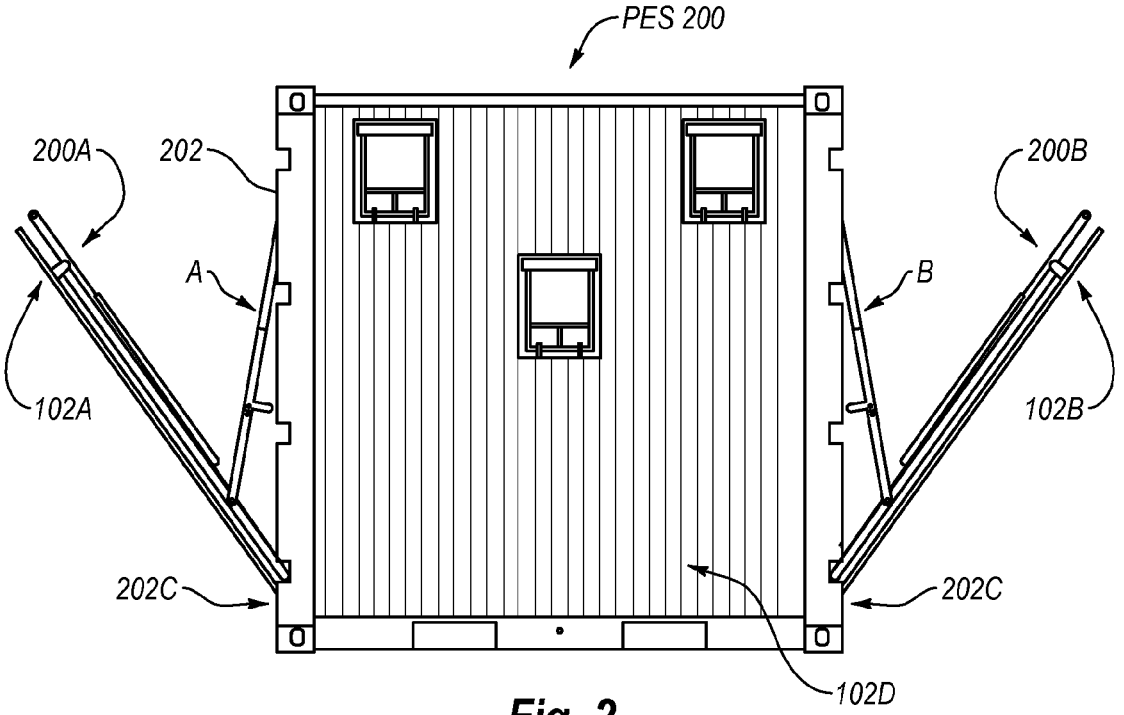
FIGS. 2 and 3 are side views of the example PES of FIG. 1, disclosing a pair of foldable frames and rotatable ends in partly deployed positions.
Figure 3:
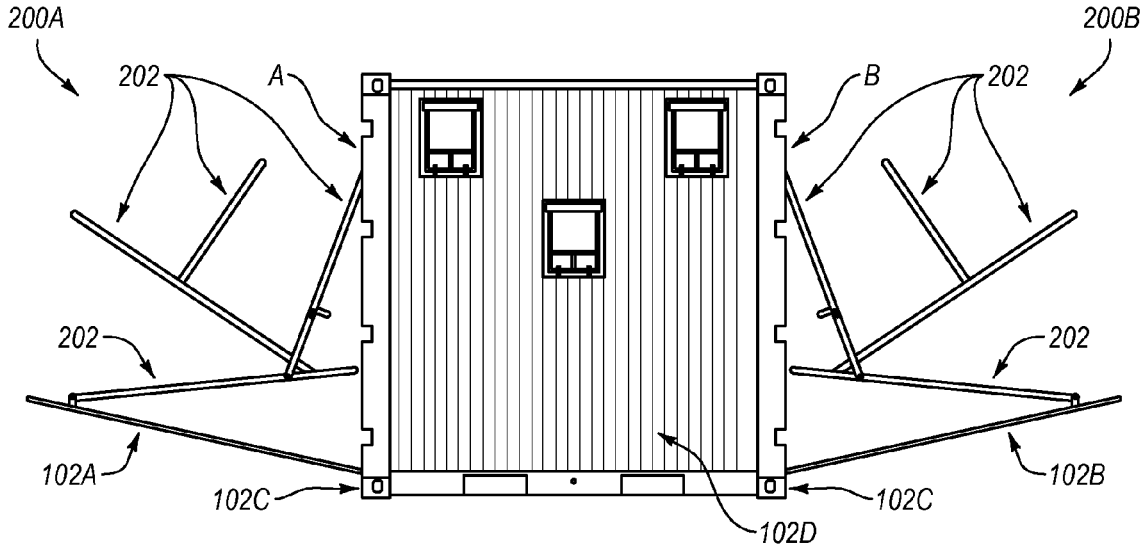
Figure 4:
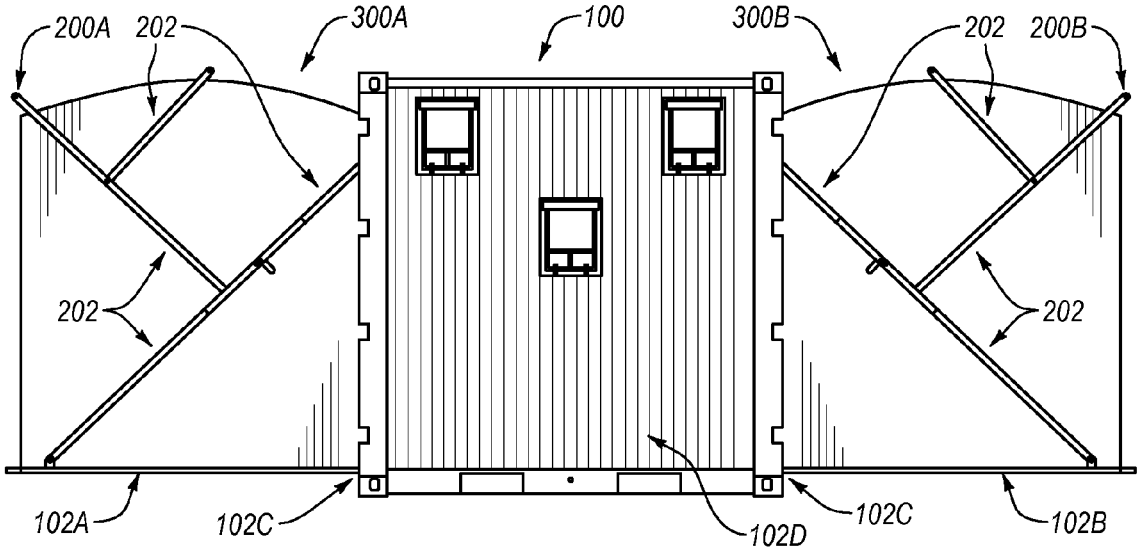
FIG. 4 is a side view of the example PES of FIG. 1, disclosing a pair of foldable frames, a pair of rotatable ends, and a pair of covers in a fully deployed position.

With reference now to the views presented in FIGS. 2-4, further details are provided concerning the example PES 100. As indicated in those Figures, the enclosure 102 of the PES 100 includes rotatable ends 102A and 102B and a bottom 102C. The example PES 100 may also include two sides 102D and 102E (only side 102D is visible in FIGS. 3 and 4) which may or may not be rotatable, and which may be connected to the bottom 102C. Alternative embodiments of the PES may employ only a single rotatable end and/or one or more rotatable sides.

In general, the movable portion(s) of a PES enable the PES to be changed from the shipping configuration indicated, for example in FIG. 1, where the PES is ready to be transported, and the deployed configuration indicated, for example, in FIG. 4.

As indicated in FIGS. 2-4, the sides 102D and 102E may be opposing sides, and the ends 102A and 102B may be opposing ends. One or both of the rotatable ends 102A and 102B may be rotatably connected, such as by a hinge or comparable device(s), to the enclosure 102. In some embodiments at least, the rotatable ends 102A and/or 102B may be connected to the PES 100 near the bottom 102C of the enclosure 102. As a result of this arrangement, the rotatable ends 102A and 102B can be moved between a substantially vertical position (see, e.g., FIG. 1), such as may be employed when the PES 100 is being transported, and a substantially horizontal position such as may be employed when the PES 100 is in use (see, e.g., FIG. 4). Moreover, and as indicated in FIGS. 2 and 3 for example, the rotatable ends 102A and 102B can assume various intermediate positions between substantially horizontal and substantially vertical.

The enclosure 102 includes suitable securement devices (not shown) for securing the rotatable ends 102A and 102B in the substantially vertical position, and the enclosure 102 may also include securement devices configured to releasably secure the rotatable ends 102A and 102B in the substantially horizontal position, the substantially vertical position, and/or in intermediate positions between substantially horizontal and substantially vertical. Such securement devices may comprise, for example, locks, pins, and bolts. The aforementioned example securement devices are example structural implementations of a means for releasably securing that may be employed with the ends and/or sides of the enclosure 102.

While some embodiments of a PES may include two rotatable portions, such as rotatable ends 102A and 102B, the scope of the invention is not so limited. Rather, other embodiments may have only a single rotatable portion, while still other embodiments may have more than two rotatable portions.

In at least some embodiments, the rotatable ends 102A and 102B and/or other portions of the enclosure 102 may include sealing elements so that when the rotatable ends 102A and 102B are secured in the substantially vertical position, the enclosure 102 is substantially watertight and/or airtight. As well, the rotatable ends 102A and 102B and/or other portions of the PES 100 may operate in conjunction with handles, dampers, hoists, motors, pulleys, ropes, cables, springs and/or other structures or devices to facilitate the raising and lowering of the rotatable ends 102A and 102B. The aforementioned components, either alone or in various combinations, are examples of structural implementations of a means for moving that may be employed with movable portions of the enclosure 102 such as the ends 102A and 102*b* and/or sides 102D and 102E.

Some embodiments of a PES may include moveable portions, such as rotatable ends and/or rotatable walls, to which are mounted, either permanently or removably, various structures, systems, equipment or devices. By way of example, a rotatable end in one embodiment of a PES may have foundations mounted to it so that when the rotatable end is in the substantially horizontal position, equipment and other items can be connected to the foundations. More generally, the rotatable end may be configured to include any structures, systems, equipment or devices that are desired to be floor mounted. Thus, when the rotatable end is in the substantially horizontal position, such systems, equipment and devices are positioned on or near the floor of the enclosed space defined by the rotatable end and the foldable frame (discussed below).

With continued attention to FIGS. 2-4, the PES 100 may further include a pair of foldable frames 200A and 200B that are connected, permanently or removably, to the enclosure 102 of the PES 100 and are configured and arranged for motion relative to the enclosure 102 of the PES 100. As used herein, 'connected' embraces both arrangements where one element, such as the foldable frame for example, is directly connected to another element, such as the enclosure for example, as well as arrangements where one element, such as the foldable frame for example, is indirectly connected to another element, such as the enclosure for example, by way of one or more intermediate structures or elements.

Figure 16:
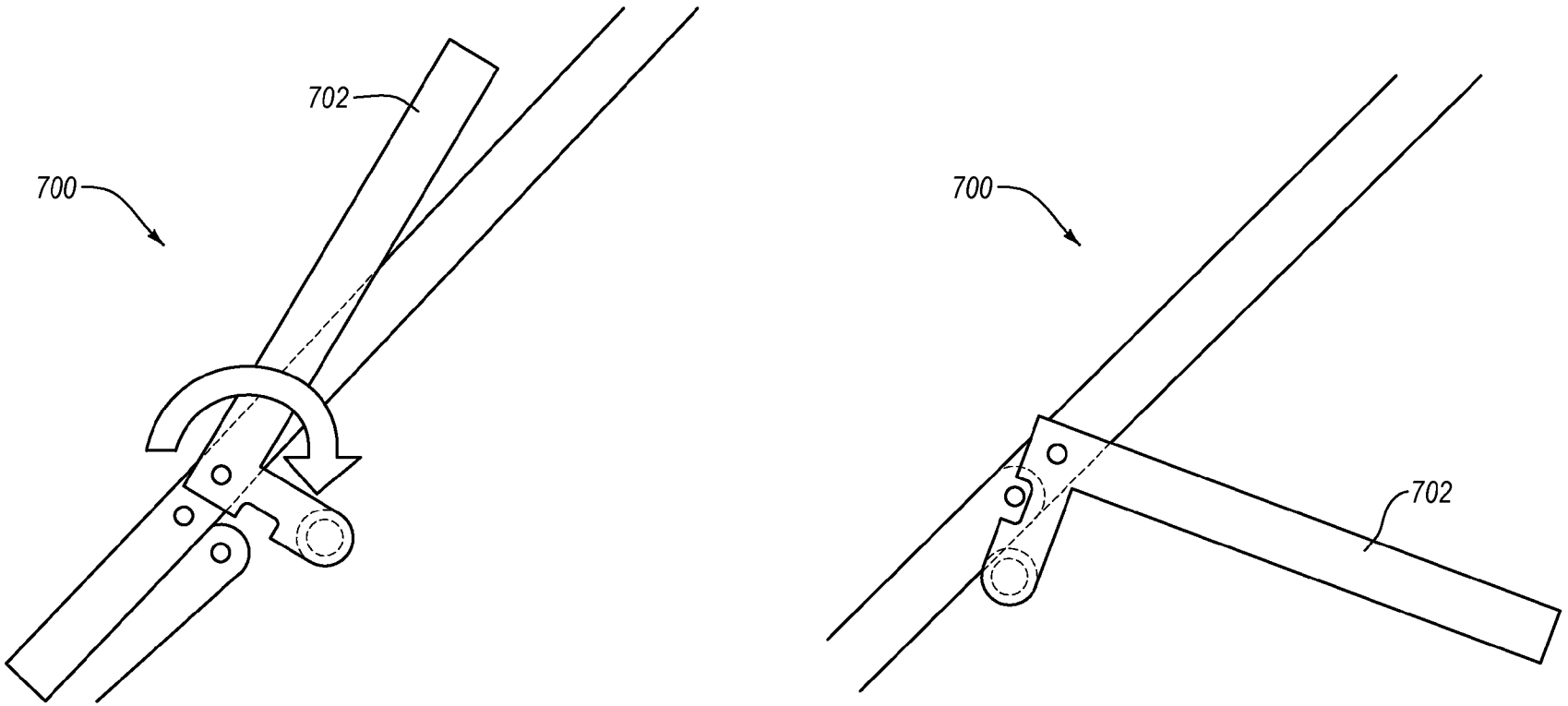
FIG. 16 discloses aspects of an example handle that can be used to manipulate, lock, and unlock a foldable frame.

Note that in one alternative embodiment, the PES has only a single foldable frame, while in other example embodiments, the PES may include more than two foldable frames. In at least some embodiments, one or both of the foldable frames 200A and 200B may include one or more locking mechanisms (see, e.g., FIG. 16) configured and arranged such that the foldable frame can be locked into a desired position, such as the position indicated in FIGS. 1 and 4 for example. The use of such a locking mechanism may help ensure that the foldable frame does not collapse or slip out of position.

In some embodiments, the foldable frames 200A and 200B are substantially the same size as each other, such that the respective spaces enclosed by each of the foldable frames, when fully unfolded, are substantially the same size. In yet other embodiments, the foldable frames 200A and 200B are of different sizes, such that the respective spaces enclosed by each of the foldable frames, when fully unfolded, are different sizes.

One or both of the foldable frames 200A and 200B may include a plurality of frame elements 202 joined together in such a way that at least one of the elements is movable relative to another of the elements. Two or more of the frame elements 202 may be permanently connected to each other, or removably connected to each other. Thus, some of the frame elements 202 may be joined together with one or more of pins, hinges, slide mechanisms and/or any other device(s) that would permit relative motion between or among two or more of the frame elements 202 of a particular foldable frame while also ensuring that the two or more frame elements 202 remain connected to each other. The aforementioned pins, hinges, slide mechanisms and other devices may, in some embodiments, be combined with a locking mechanism to form a mechanism that not only enables relative motion between frame elements 202 but also enables those frame elements 202 to be locked into a desired position relative to each other.

Consistent with their role as load bearing members, discussed in further detail below, example embodiments of the frame elements employed in a foldable frame are strong enough to handle relatively large loads without deforming or failing. As noted elsewhere herein, example embodiments of the PES include an enclosure that may take a form similar in configuration to a portion of an ISO container, or may in fact comprise a portion of an actual ISO container. Thus, at least some embodiments of the foldable frame are robust enough to support, from above, some or all of a side or end of such an enclosure.

With more particular reference now to their construction, the frame elements 202 may be comprised of a variety of different materials. For example, one or more of the frame elements 202 may comprise one or more of metal, plastic, fiberglass, wood, or carbon fiber material. The frame elements 202 may be implemented in a variety of different forms as well. For example, one or more of the frame elements 202 may be flat or round, and tubular or substantially solid. As well, the frame elements 202 may have various cross-sectional shapes including, but not limited to, flat, round, square, rectangular, polygonal, I-beam, and T-beam. Further, the group of frame elements 202 used in any given foldable frame may be substantially uniform in terms of their size, shape, and material or may vary in terms of their size, shape and material. More generally however, the scope of the invention is not limited to any particular configuration of frame element(s) 202.

In at least one embodiment, the foldable frames 200A and 200B are connected to the enclosure 102 at points A (one location at each side) and B (one location at each side) with pins and/or other devices that enable at least a portion of each of the foldable frames 200A and 200B to rotate relative to a portion of the enclosure 102. Other suitable attachments devices may alternatively be used however. One or both of the foldable frames 200A and 200B may be permanently or removably connected to the enclosure 102.

In addition to being connected to the enclosure 102, the foldable frames 200A and 200B are also connected to rotatable end 102A and rotatable end 102B, respectively. One consequence of this arrangement is that one or more frame elements 202 of the foldable frames 200A and 200B move in unison with a respective rotatable end.

Additionally, because the foldable frames 200A and 200B of this embodiment are connected to both the enclosure 102 and the rotatable ends 102A and 102B, respectively, the foldable frames 200A and 200B are able to support the rotatable end 102A and 102*b*, respectively, in the substantially horizontal position. In some embodiments at least, such a configuration and arrangement eliminates the need for separate support structures and mechanisms to support the rotatable ends 102A and 102B in the substantially horizontal position. These and/or other embodiments eliminate, particularly, the need for supporting the rotatable ends 102A and 102B from below when the rotatable ends 102A and 102B are in the substantially horizontal position. This functionality may be particularly useful where the surface upon which the PES 100 is resting or intended to rest is unlevel, soft and/or uneven or otherwise configured and/or oriented such that supporting the rotatable ends 102A and/or 102B from below would be impractical and/or ineffective.

As the foregoing discussion suggests, at least some embodiments of the foldable frame serve not only to at least partially define the boundaries of a space which can be substantially enclosed with a cover, as discussed below, but also to provide structural support for the movable portion with which the foldable frame is associated. That is, at least some embodiments of a foldable frame constitute load bearing structures, inasmuch as such embodiments serve to support, from above, a movable portion of an enclosure in one or more positions, such as a substantially horizontal position for example.

In some embodiments, the foldable frame is supplemented with other systems and/or devices that likewise serve to support the movable portion of the enclosure from above. Such systems and devices include, for example, one or more of cables, chains, ropes, tensioners, pulleys, sheaves, springs, motors, and components for manual operation of the aforementioned devices and systems. Such systems and devices may be employed, for example, where the movable portion associated with the foldable frame is relatively large and/or where the movable portion is required to support relatively heavy loads when in the substantially horizontal position.

With more specific reference now to the example of rotatable end 102A and foldable frame 200A of FIGS. 2-4, a rotation of rotatable end 102A, for example, from the substantially vertical position to the substantially horizontal position causes foldable frame 200A to move from a stowed configuration (FIG. 1) where the foldable frame 200A is substantially disposed within the interior of the enclosure 102 to a deployed configuration (FIG. 4). Thus, when a user moves rotatable end 102A to the position indicated in FIG. 4, the foldable frame 200A is automatically moved at the same time to the deployed position indicated in FIG. 4.

One useful aspect of this arrangement and relation is that the PES 100 can be quickly and easily set up and struck down since there is no need to assemble, and then position, a frame to cover and enclose the additional floor space provided by the rotatable end 102A. Instead, the foldable frame 200A is automatically deployed as a result of the rotation of the rotatable end 102A. In similar fashion, the PES 100 can be quickly collapsed by simply rotating the rotatable end 102A from the substantially horizontal position to the substantially vertical position. That is, since some or all elements of the foldable frame 200A move in unison with rotatable end 102A, movement of the rotatable end 102A to the substantially vertical position causes the foldable frame 200A to move automatically to the stowed position.

As the foregoing example illustrates, example embodiments of a PES that includes a foldable frame may eliminate the need for special tools or significant labor in setting up and striking down the PES. As well, the configuration of example embodiments of the PES may enable relatively rapid set up and strike down of the PES. As a further example, the configuration of example embodiments of the PES may eliminate the need for ancillary support mechanisms to maintain the PES in a deployed state.

As noted elsewhere herein, and disclosed in FIG. 4, at least some embodiments of the PES include one or more covers 300A and 300B that may be permanently or removably connected to a corresponding folding frame and/or enclosure.

With particular reference to the example of cover 300A, the cover 300A may be connected to foldable frame 200A so as to move in unison with foldable frame 200A and, thus, with the rotatable end 102A. More particularly, the cover 300A may be connected to foldable frame 200A such that when foldable frame 200A is moved to the deployed position as a result of movement of the rotatable end 102A to the substantially horizontal position, the cover 300A unfolds to substantially enclose the extended space cooperatively defined by the rotatable end 102A and the foldable frame 200A. In similar fashion, movement of the foldable frame 200A to the stowed position in the interior of the enclosure 102, which results from movement of the rotatable end 102A to the substantially vertical position, causes the cover 300A to be automatically folded into the interior of the enclosure 102.

As well, the covers 300A and 300B may be connected to the enclosure 102 in such a way that leakage of water and/or air/wind to/from the interface between the enclosure 102 and the covers 300A and 300B is substantially prevented. In some embodiments, a cover 300 may be positioned within its corresponding foldable frame while, in other embodiments, the cover 300 may be arranged to fit over its corresponding foldable frame.

In one example embodiment, a PES may be configured to operate under positive pressure such that the pressure inside the enclosed area defined by the rotatable end(s) and the corresponding cover(s) is greater than the pressure outside the PES. The positive pressure could be established and maintained by any suitable device(s), such as fans or blowers for example. Such a configuration and capability to enable and sustain a positive pressure environment may be useful in environments where, for example, a nuclear, biological or chemical (NBC) attack may have occurred or may be anticipated.

With continued attention to a cover, such as covers 300A and 300B for example, a variety of different covers may be employed in various embodiments. One or more of the covers may comprise a flexible material, or materials, that may or may not be waterproof. Examples of suitable flexible materials include, but are not limited to, fabrics such as canvas, rubberized fabrics, nylon, plastic, ripstop materials, waterproof materials, windproof materials, breathable materials, and flexible materials that incorporate one or more of the aforementioned characteristics and/or materials. As well, the covers may or may not include one or more of the various types of insulation disclosed herein. The covers employed in a particular PES may all be the same, or may differ from each other in one or more ways.

Some or all portions of a given cover may be opaque, partly transmissive to light, or substantially transmissive to light. In at least some embodiments, a cover is provided that is substantially opaque but includes one or more windows that comprise a material that is at least partially transmissive to light. As well, some covers may include one or more openings that can be covered and uncovered by a flap or similar element such that the interior of the extended enclosure can communicate with the outside environment. The flaps may be securable by any suitable device, examples of which include zippers, and a hook and loop closure system. At least some embodiments of a cover may also include one or more portions comprising mesh or similar material that is suited to enable airflow into and out of the area by the cover.

In some embodiments, the covers 300A and 300B may be substantially the same as each other in terms of one or more characteristics such as size, shape and materials. In yet other embodiments, the covers 300A and 300B may differ from each other in terms of one or more characteristics such as size, shape, and materials.

Figure 5:
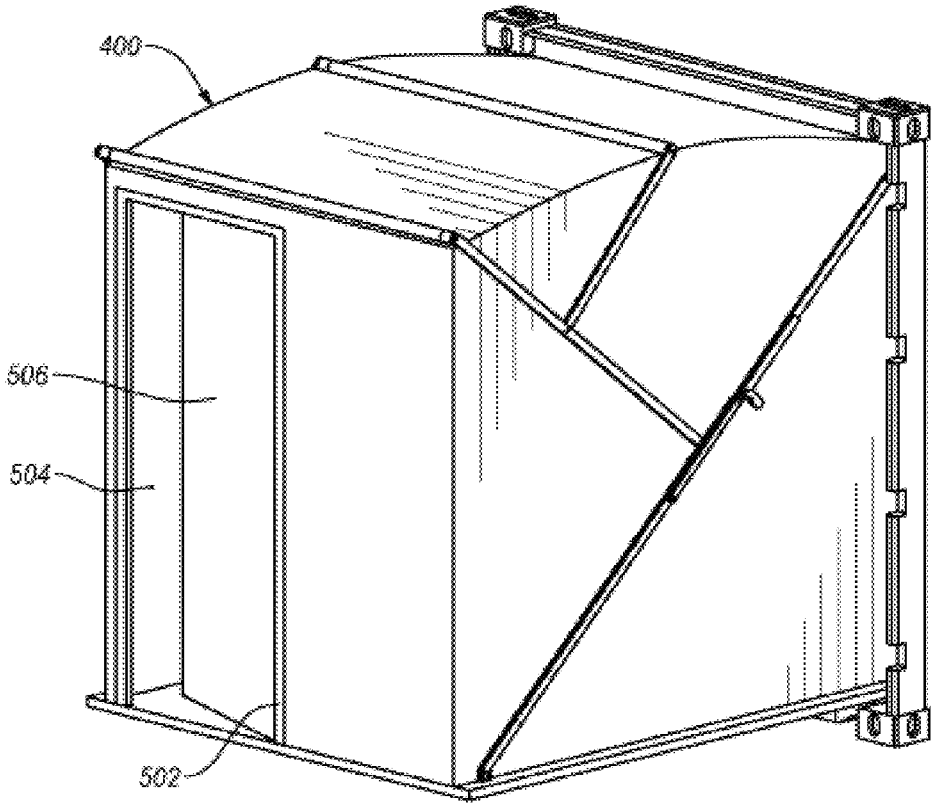
FIG. 5 is a partial perspective view of the example PES of FIG. 4, disclosing the extended enclosure defined by the foldable frame and rotatable end, and further disclosing a door of the extended enclosure.
Figure 6:
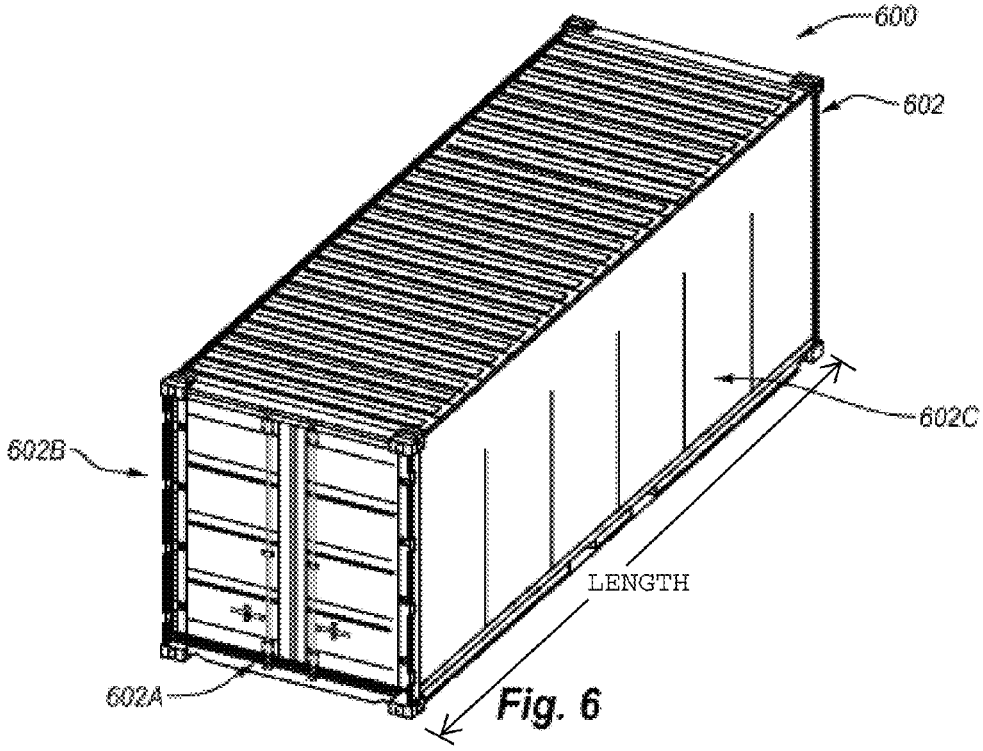
FIG. 6 is a perspective view of an alternative embodiment of a PES.
Figure 7A:
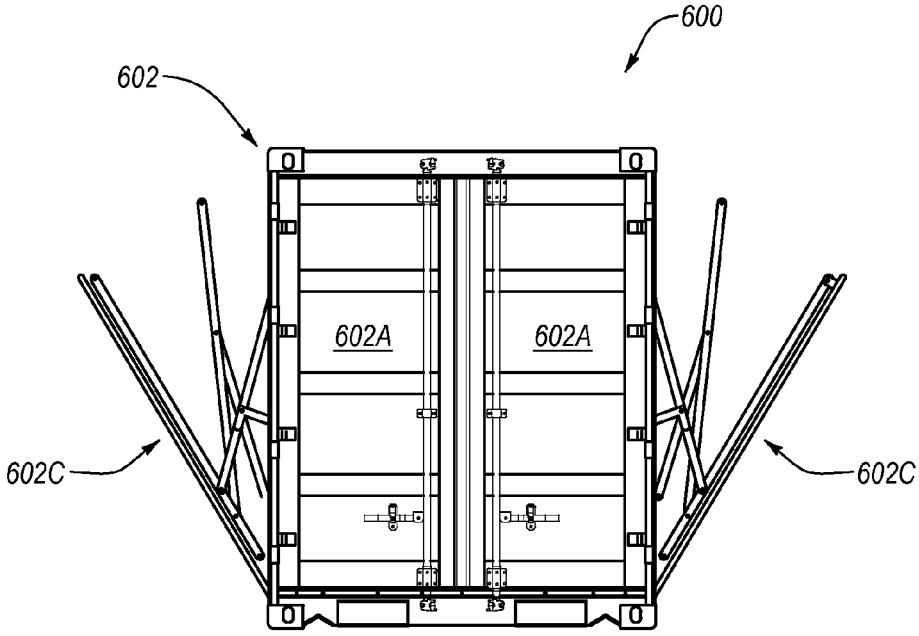
FIGS. 7A and 7B are an end view of the example PES of FIG. 6, disclosing a pair of foldable frames and rotatable sides in partly deployed positions.
Figure 7B:
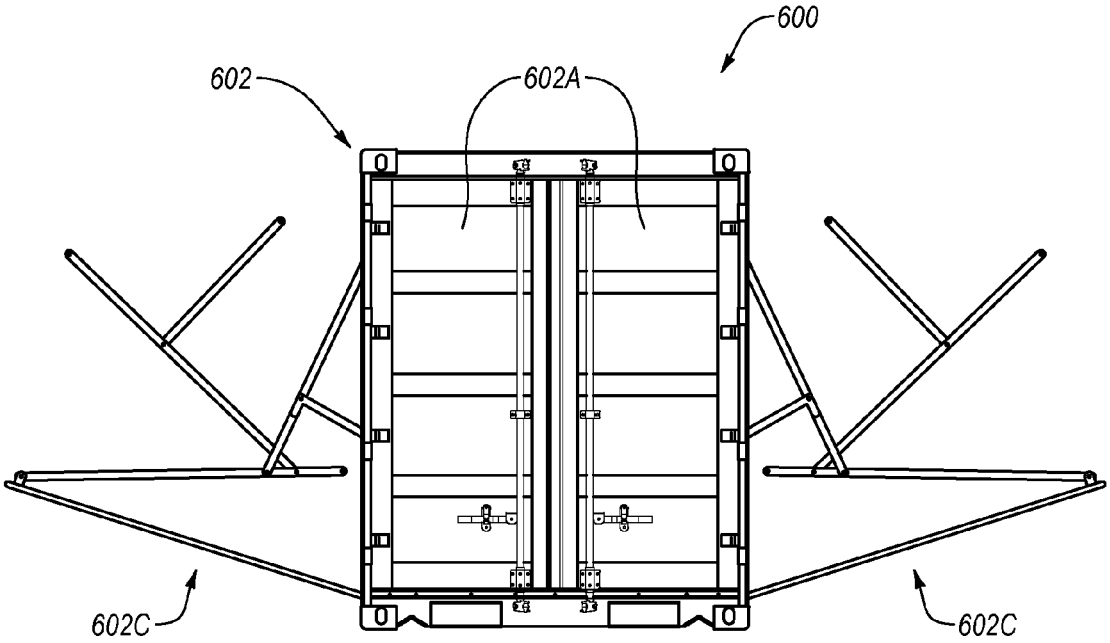
Figure 8:
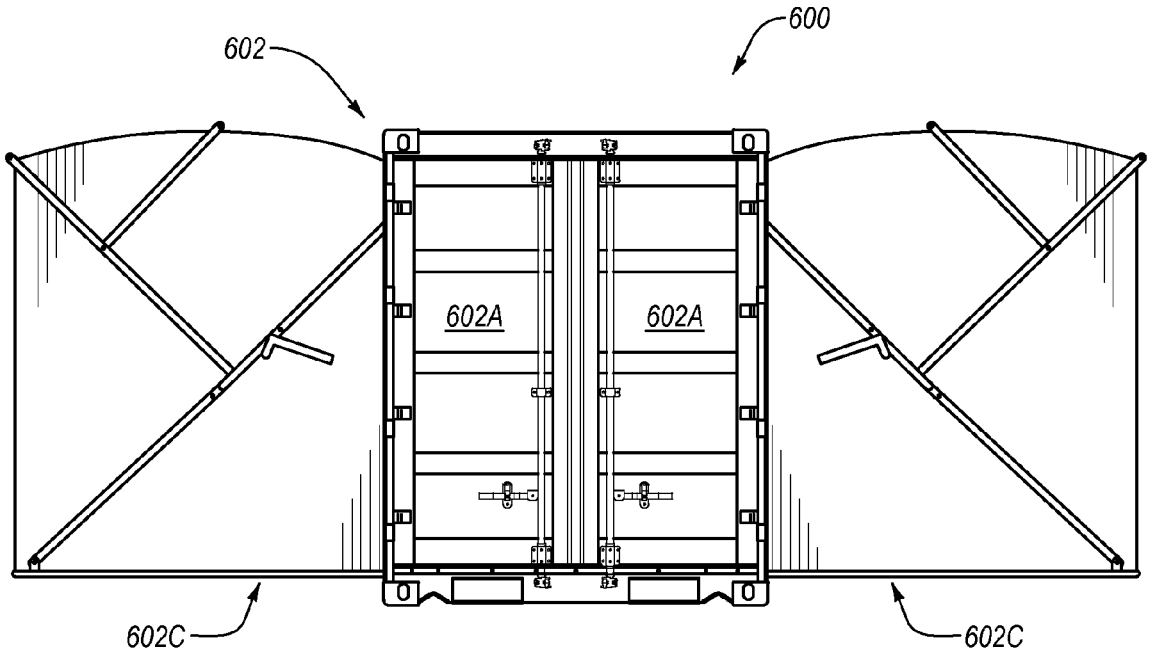
FIG. 8 is a side view of the example PES of FIGS. 7A and 7B, disclosing a pair of foldable frames, a pair of rotatable sides, and a pair of covers in fully deployed positions.
Figure 9:
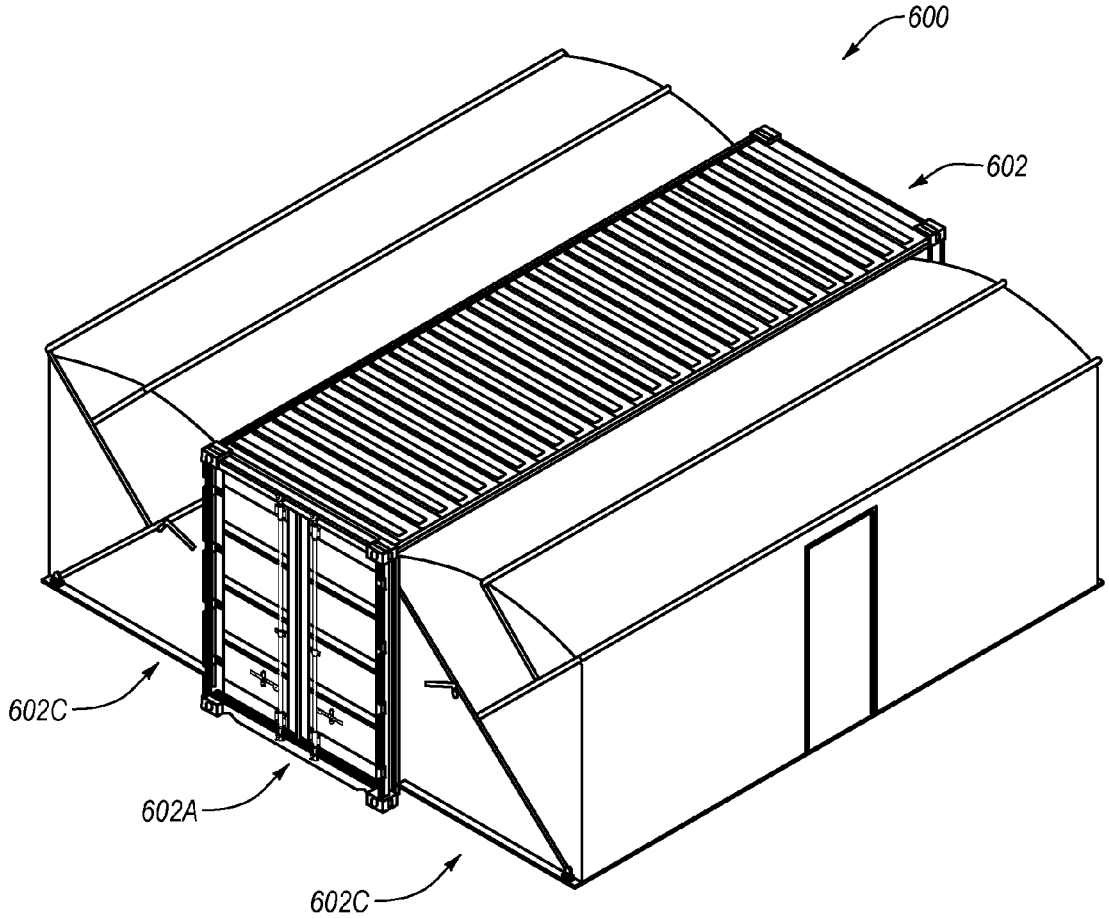
FIG. 9 is a perspective view of the example PES of FIG. 8.
Figure 10A:
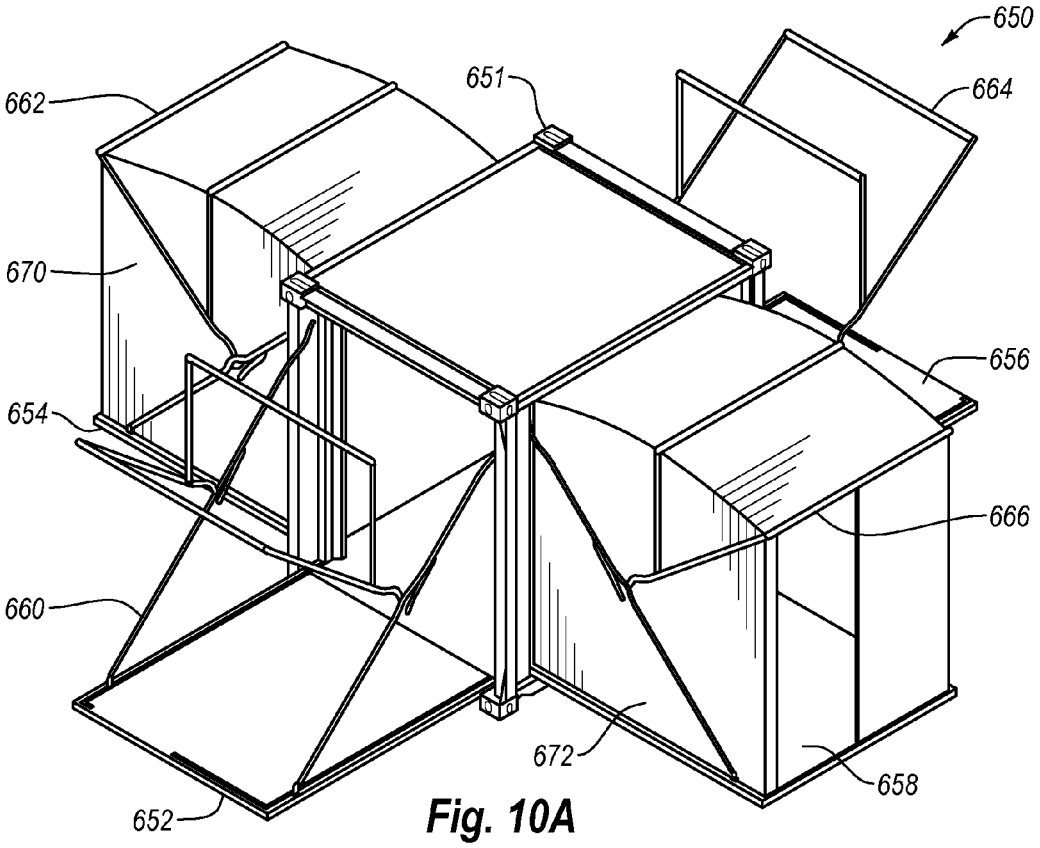
FIGS. 10*a*-10*d* disclose aspects of an example of a PES whose enclosure includes one or more movable sides and one or more movable ends.
Figure 10B:
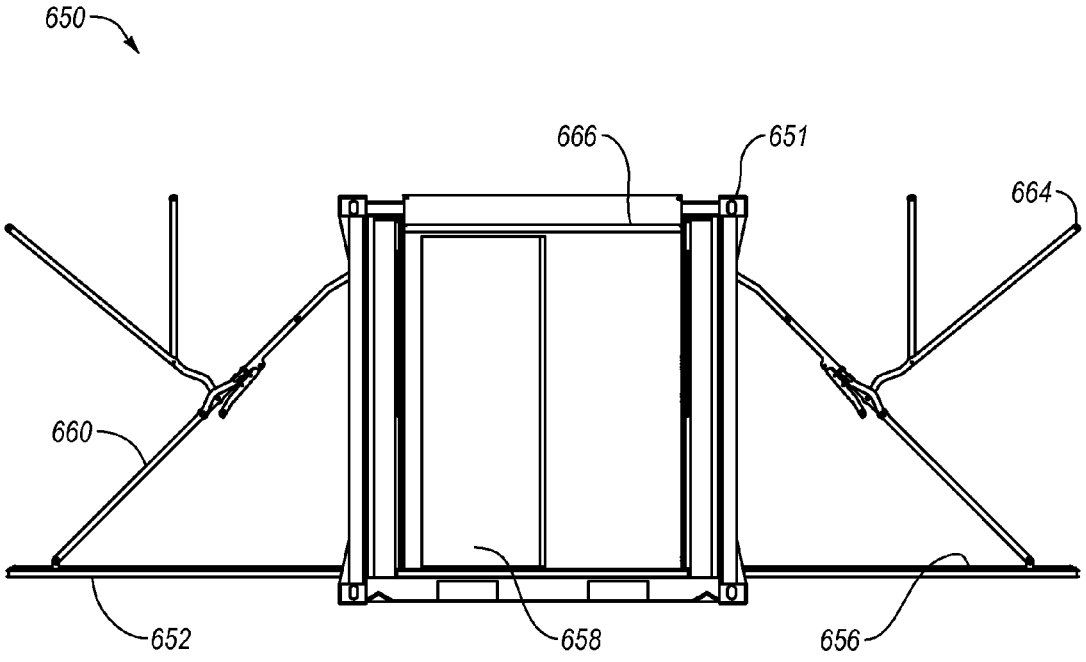
Figure 10C:
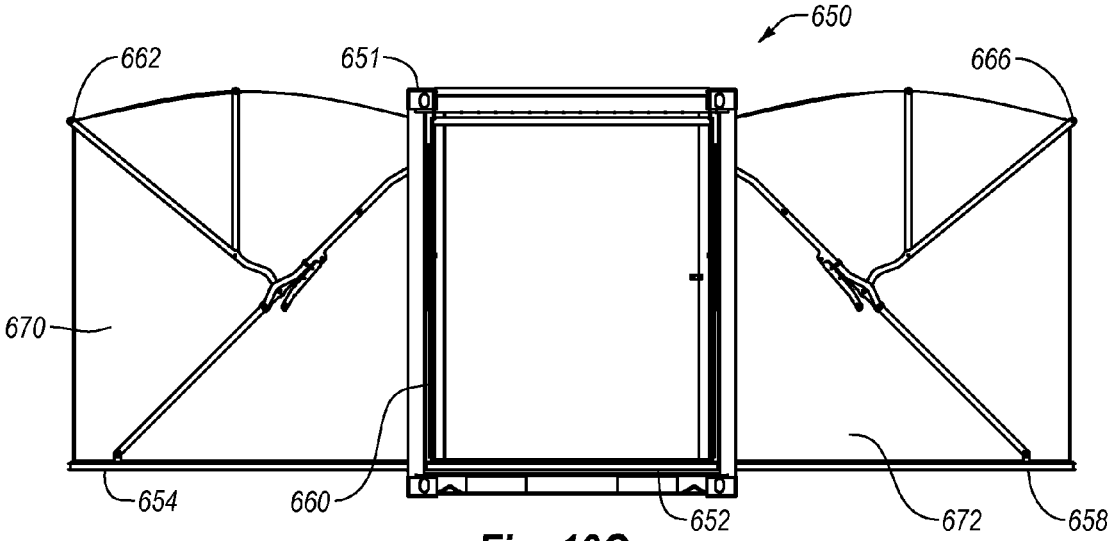
Figure 10D:
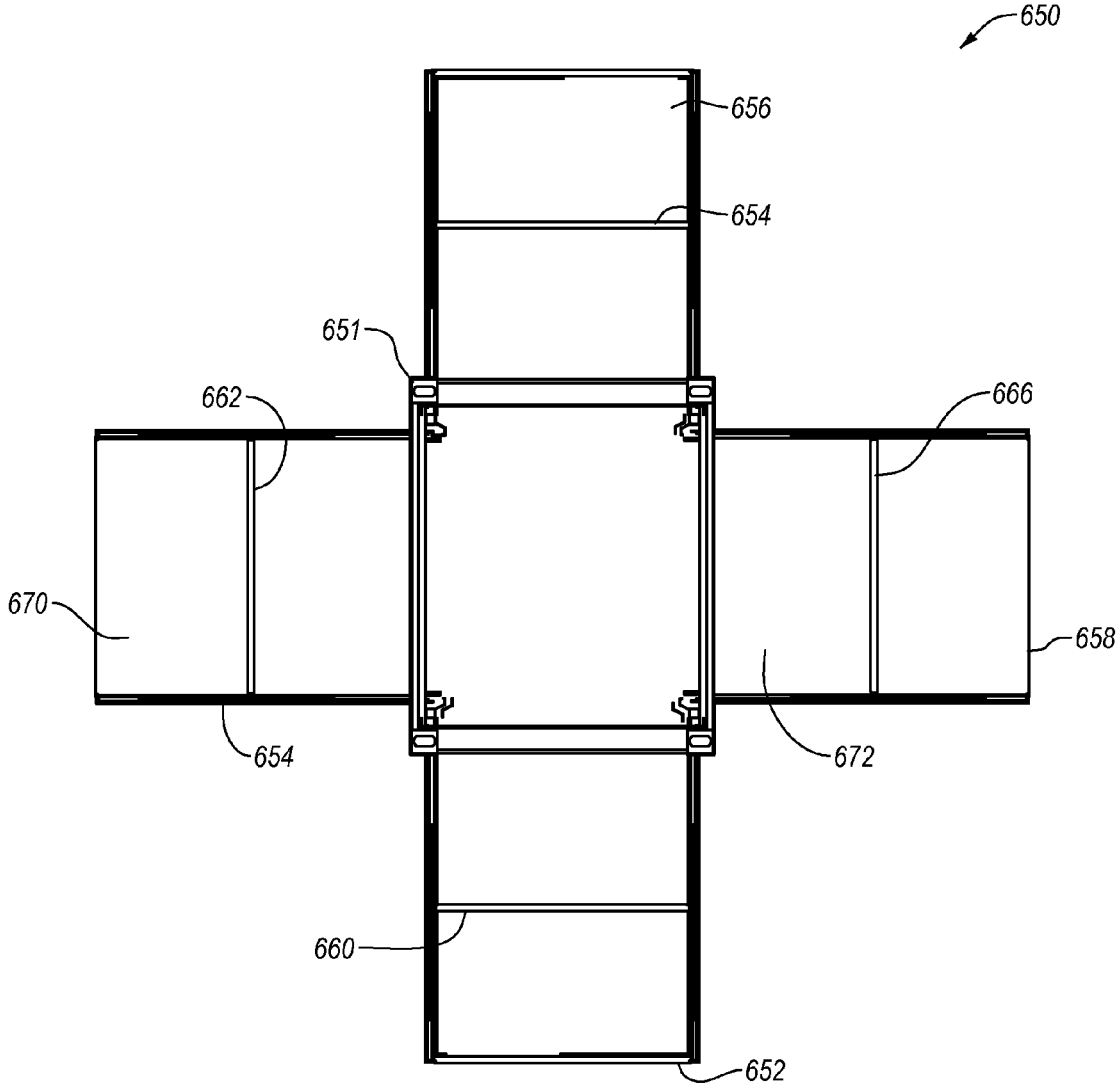
Figure 11:
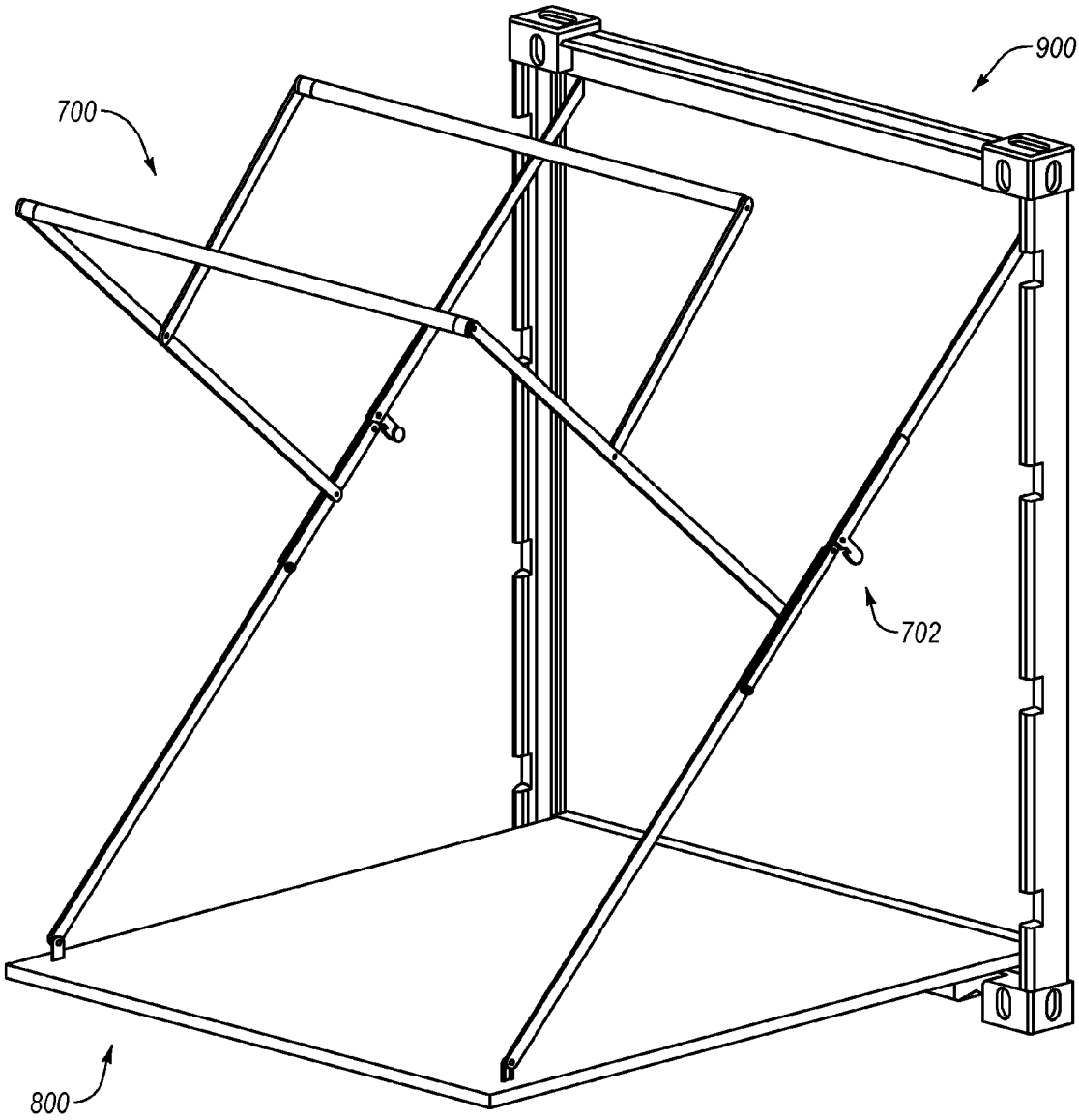
FIGS. 11-15 show an example foldable frame as it is moved from a fully deployed position (FIG. 11) to a fully retracted position (FIG. 15)
Figure 12:
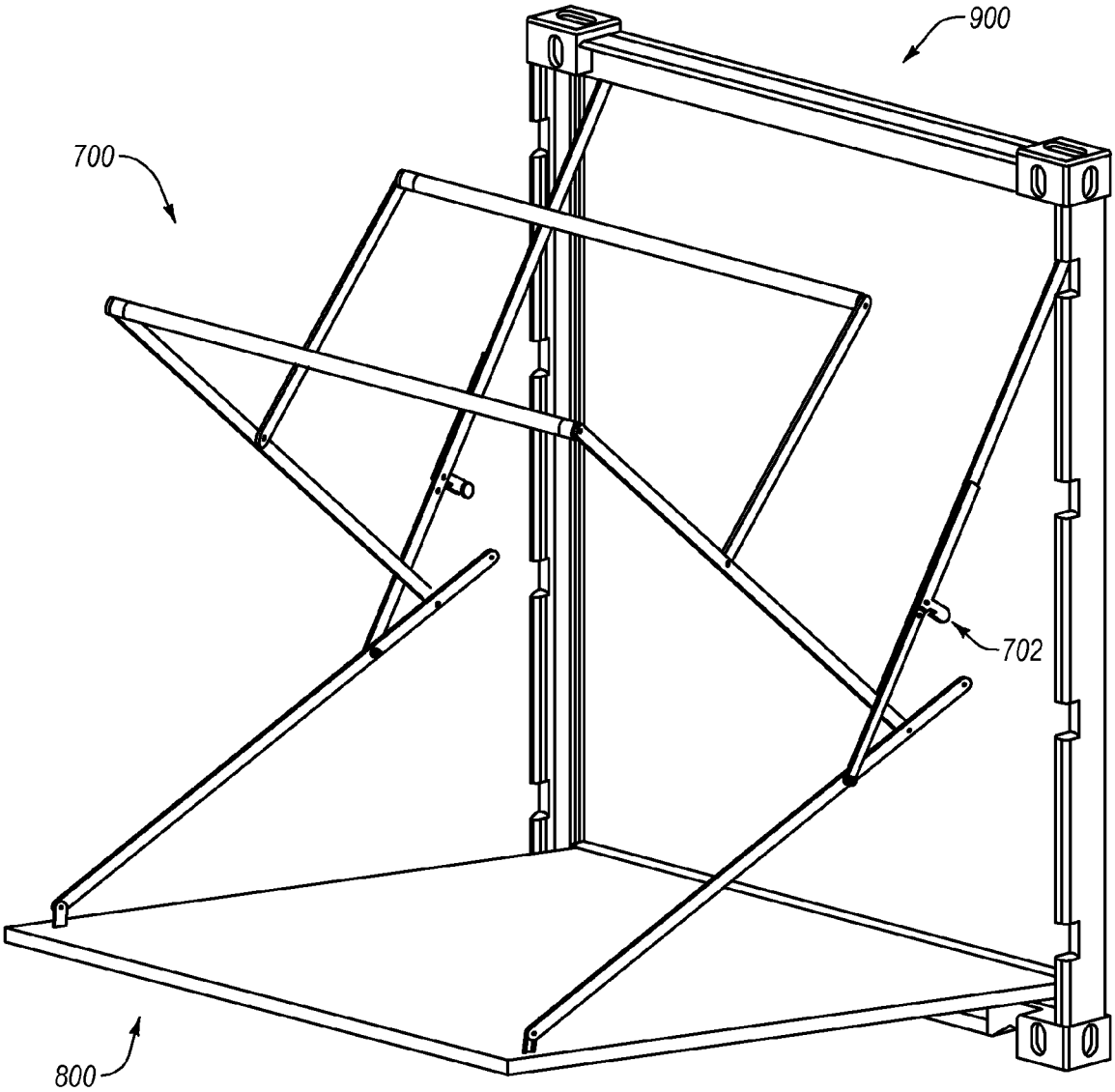
Figure 13:
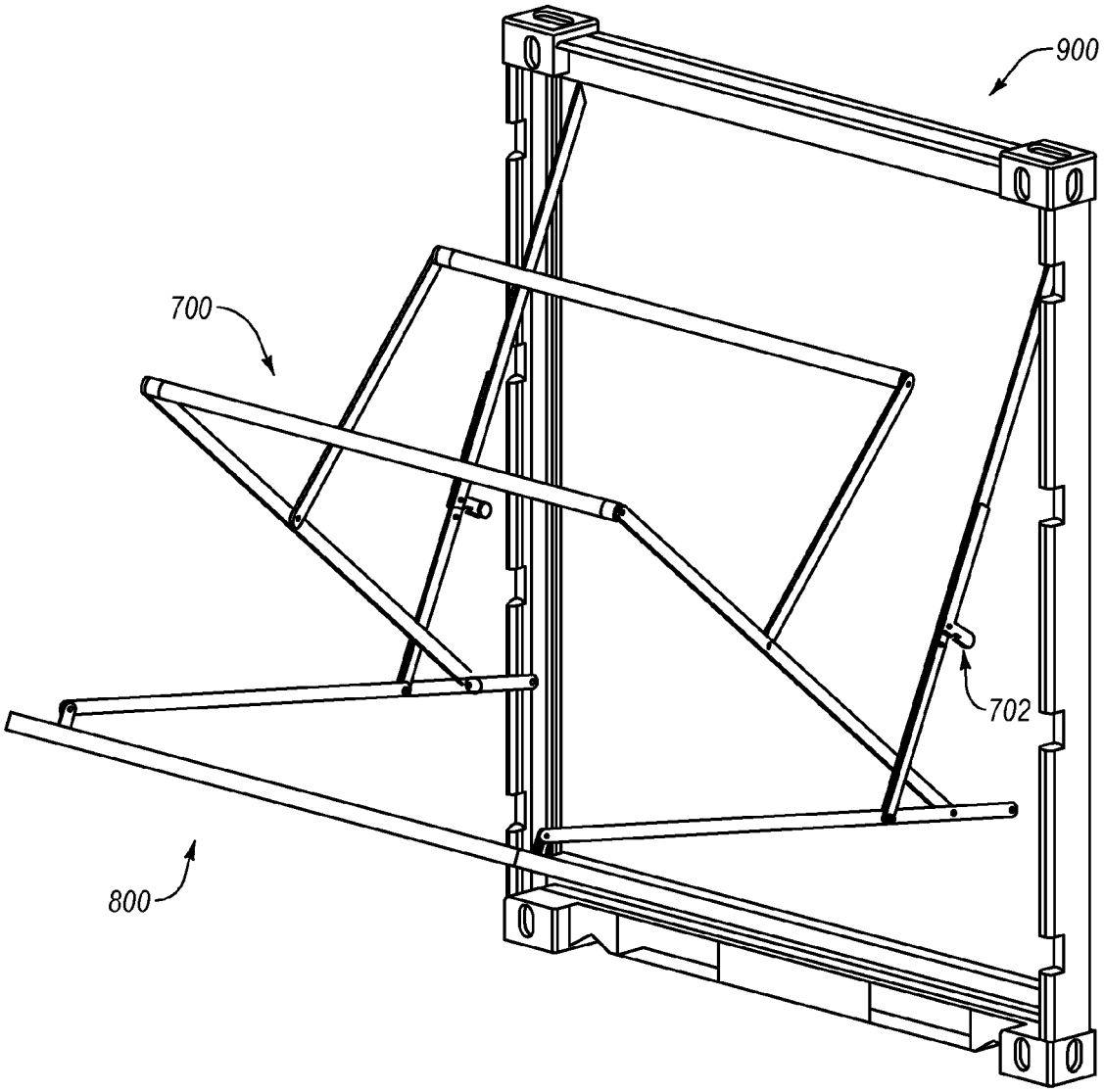
Figure 14:
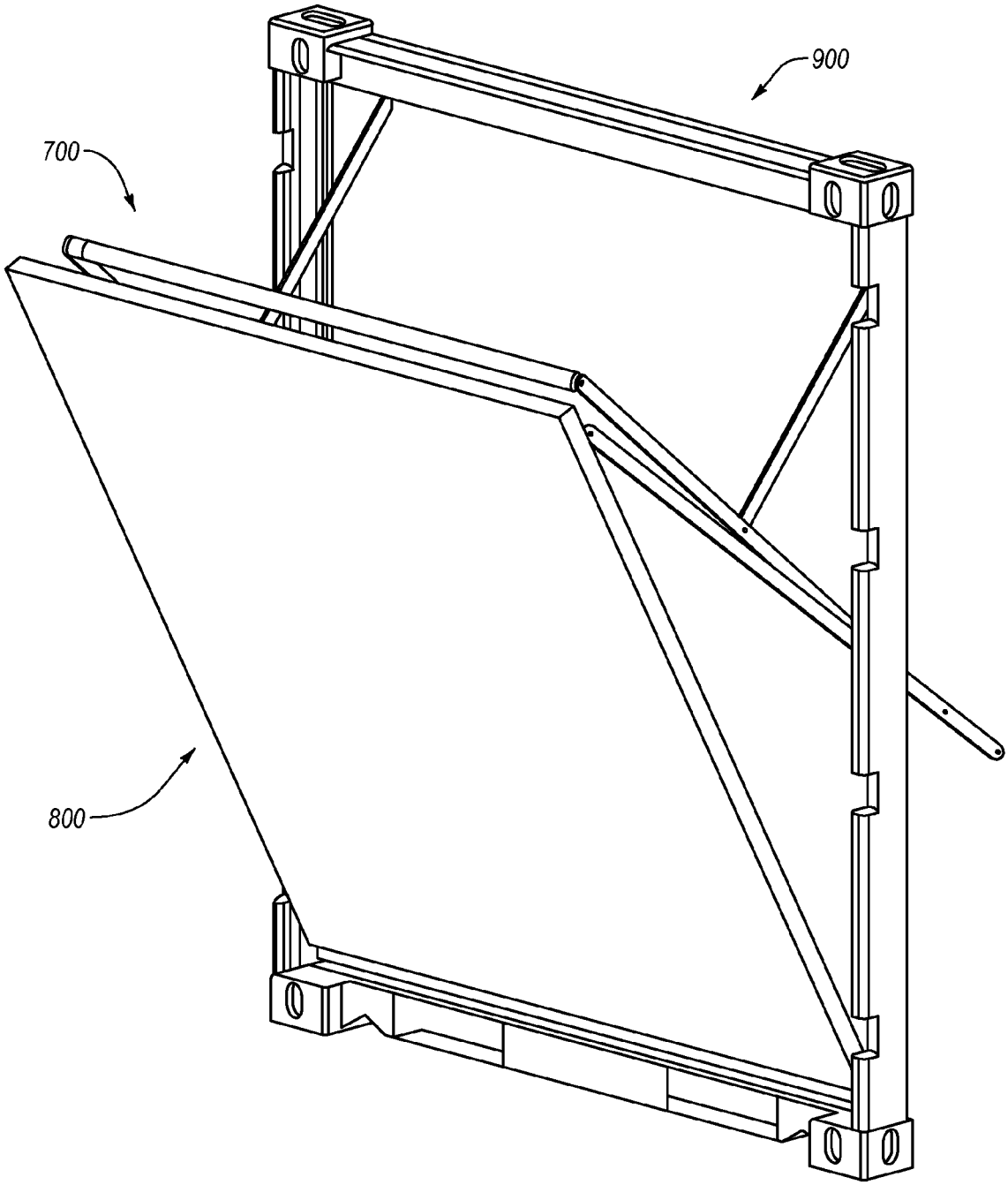

Turning now to FIG. 5, at least some embodiments of the PES further include a cover 400 having a door frame 502 that defines an opening 504 that can be accessed by way of a door 506. The door 506 may be comprised of any suitable material(s) including, but not limited to, fabric, rubber, composites such as glass composites or carbon composites, metal, glass, wood, fiberglass, and plastic. Thus, the door 400 may be substantially constructed of rigid material(s), or may alternatively be substantially constructed of flexible material(s), examples of which include the cover materials disclosed herein. In at least one embodiment, the door frame 502 is connected to a corresponding foldable frame and/or to a movable portion of the enclosure, such as a rotatable end, such that upon unfolding of the foldable frame into the deployed position, the door frame 502 and door 506 are automatically deployed to the position indicated in FIG. 5.

In this example, the cover 400 includes an opening that is positioned around, and attachable to, the door frame. The door frame, which may be of tubular metal, fabric or other suitable construction, can be connected, removably or not, to the cover with suitable securement devices, examples of which include hook and loop closures, or zip ties.

In one alternative embodiment, the door 506 is connected to a rotatable portion of the enclosure, such as a rotatable end, in such a way that upon movement of the associated foldable frame to the deployed position, a user can enter a doorway or other opening defined in the cover and raise the door 506 and secure it in the position indicated in FIG. 5. When it is desired to collapse this embodiment, a user can release the door and lower it into contact with, and secure it to, the rotatable end, so as to enable movement of the foldable frame to the stowed position. In at least some embodiments, the door frame of the door 506 is connected to the rotatable end such that the door frame can be rotated into the position indicated in FIG. 5.

Directing attention now to FIGS. 6-9, details are provided concerning another example embodiment. As the embodiment of FIGS. 6-9 is similar in a number of regards to embodiments embraced by FIGS. 1-5, the following discussion is limited to selected aspects of this example embodiment.

In the example of FIGS. 6-9, PES 600 includes an enclosure 602 that may take the form of a 20 foot ISO container. In one alternative embodiment, the PES 600 is implemented as a 40 foot long ISO container.

In contrast with the enclosure 102, the enclosure 602 includes a pair of double doors 602A on one or both ends, and the enclosure 602 includes one or more rotatable sides 602C, rather than ends in the case of enclosure 102, connected to the enclosure 602 in a manner similar to that in which rotatable ends 102A and 102B are connected to enclosure 102. In most, if not all, regards other than these, the discussion of the PES 100 is substantially germane to the PES 600. As one example, and as disclosed elsewhere herein, other embodiments of the PES 600 may include one or more rotatable sides and one or more rotatable ends, along with corresponding foldable frames and covers. In at least some embodiments, multiple foldable frames are employed with at least one of the rotatable sides so that, for example, three separate enclosures, arranged side-by-side, are defined by a rotatable side 602C and three foldable frames connected to the rotatable side 602C.

With attention now to FIGS. 10*a*-10*d*, details are provided concerning another embodiment of a PES, denoted generally at 650. The PES 650 includes an enclosure 651 having four movable portions 652, 654, 656, and 658 although, as noted herein, other PES embodiments may have different numbers of movable portions. Each of the movable portions 652, 654, 656, and 658 may be configured and operable generally as disclosed in the discussion of other movable portions elsewhere herein. As further indicated in FIGS. 10*a*-10*d*, each of the movable portions 652, 654, 656, and 658 is connected to a corresponding foldable frame 660, 662, 664, and 666, respectively. Each of the foldable frames 660, 662, 664, and 666 may be configured and operable generally as disclosed in the discussion of other foldable frames elsewhere herein. Finally, and as indicated particularly in FIGS. 10*a* and 10*c*, a cover 670, 672 may be employed with one or more of the foldable frames, e.g., 662 and 666. Although not shown, the PES 650 of FIGS. 10*a*-10*d* may include four covers, one for each of the foldable frames 660, 662, 664, and 666. The covers 670 and 672 may be configured generally as disclosed in the discussion of other covers elsewhere herein.

Figure 15:
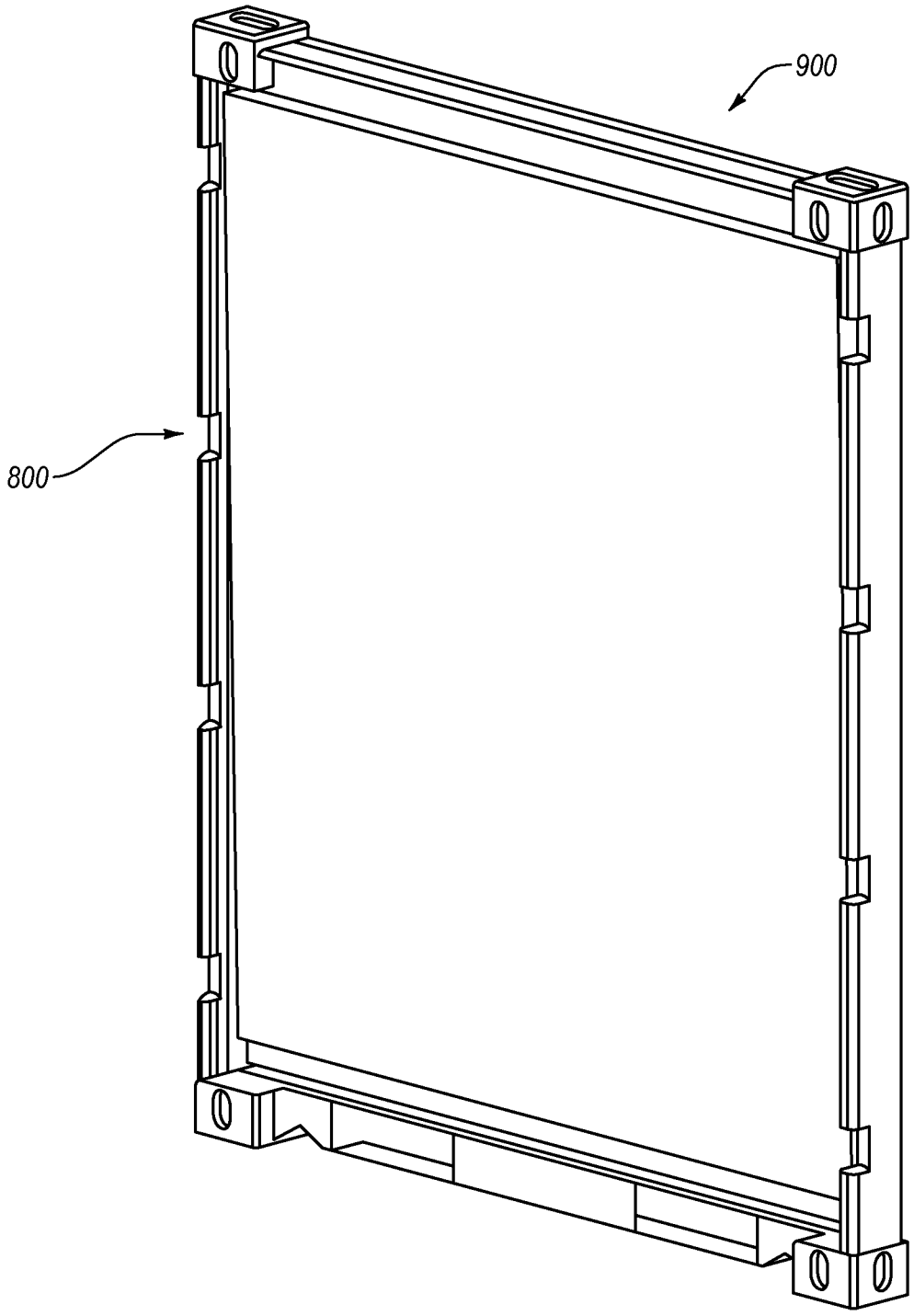

Turning finally to FIGS. 11-16, an example foldable frame 700 is shown that is connected to rotatable portion 800 of an enclosure 900. The foldable frame 700 is also connected to the enclosure 900. As indicated in those figures, and in FIG. 16, a handle 702 can be used to manipulate, or assist in manipulation of, the foldable frame 700 in such a way that the foldable frame 700 can be moved from the fully deployed position of FIG. 11 to the fully retracted position of FIG. 15. As further indicated in the figures, rotation of the rotatable portion 800 from a substantially horizontal position (FIG. 11) to a substantially vertical position (FIG. 15) correspondingly causes the foldable frame 700 to move, for example, from the fully deployed position (FIG. 11) through an intermediate position (FIG. 14), to the fully retracted position inside the enclosure 900 (FIG. 15).

The example embodiments disclosed herein may be embodied in other specific forms. These example embodiments are to be considered in all respects only as illustrative and not restrictive.

What is claimed is:

1. A portable expandable shelter, comprising:

an enclosure having a fixed portion and a movable portion that comprises one or more of a side and an end of the enclosure, the movable portion of the enclosure being movable between a substantially vertical position and a substantially horizontal position;

a flexible cover connected to the enclosure such that while changing the movable portion between the substantially vertical position and the substantially horizontal position the flexible cover remains attached to the enclosure;

a rigid, load bearing, foldable frame to which the flexible cover is connected, the rigid, load bearing, foldable frame being connected to the movable portion and to the fixed portion of the enclosure in both the substantially vertical position and the substantially horizontal position, and the rigid, load bearing, foldable frame changing between a stowed position and a deployed position in response to the movable portion of the enclosure changing between the substantially vertical position and the substantially horizontal position such that the flexible cover comprises a top portion of an additional volume of the shelter and encloses the additional volume when the foldable frame is in the deployed position, and wherein:

the rigid, load bearing, foldable frame comprises a first frame element and a second frame element;

the first frame element hingedly folds onto the second frame element when in the stowed position; and the rigidity of the foldable frame provides load bearing support to the movable portion when the movable portion is in the substantially horizontal position.

2. The portable expandable shelter of claim 1, wherein:

responsive to movement of the movable portion of the enclosure from the substantially vertical position to the substantially horizontal position, the rigid, load bearing, foldable frame moves from the stowed position to the deployed position; and responsive to movement of the movable portion from the substantially horizontal position to the substantially vertical position, the rigid, load bearing, foldable frame moves from the deployed position to the stowed position.

3. The portable expandable shelter of claim 1, wherein:

when the rigid, load bearing, foldable frame is in the deployed position, the flexible cover substantially encloses a space at least partly defined by the rigid, load bearing, foldable frame and the movable portion of the enclosure; and when the rigid, load bearing, foldable frame is in the stowed position, a substantial portion of the flexible cover is stowed in an interior of the enclosure.

4. The portable expandable shelter of claim 1, wherein the movable portion of the enclosure comprises one of the sides of the enclosure.

5. The portable expandable shelter of claim 1, wherein the movable portion of the enclosure comprises one of the ends of the enclosure.

6. The portable expandable shelter of claim 1, wherein the portable expandable shelter comprises one of a TRICON, a BICON, and a QUADCON.

7. The portable expandable shelter of claim 1, wherein the enclosure of the portable expandable shelter is substantially similar in configuration to a 20 foot long ISO shipping container.

8. The portable expandable shelter of claim 1, wherein the enclosure of the portable expandable shelter is substantially similar in configuration to a 40 foot long ISO shipping container.

9. The portable expandable shelter of claim 1, wherein the enclosure of the portable expandable shelter is less than about 20 foot long.

10. The portable expandable shelter of claim 1, wherein the enclosure of the portable expandable shelter is greater than about 20 foot long and less than about 40 feet long.

11. The portable expandable shelter of claim 1, wherein the enclosure of the portable expandable shelter is greater than about 40 foot long.

12. A portable expandable shelter, comprising:

an enclosure that defines an interior and includes a top, bottom, two sides and two ends, each of the sides and ends comprising a movable portion of the enclosure, each of the movable portions of the enclosure being movable between a substantially vertical position and a substantially horizontal position, each of the movable portions corresponding to:

a flexible cover connected to the enclosure and at least partially defining a doorway;

a foldable frame to which the flexible cover is connected, the foldable frame being connected to the corresponding movable portion and to the enclosure, and the foldable frame being configured to move between a stowed position and a deployed position in response to movement of the corresponding movable portion between the substantially vertical position and the substantially horizontal position, and the foldable frame provides rigid load bearing support and retains the corresponding movable portion when the corresponding movable portion is in the substantially horizontal position; and wherein:

the foldable frame comprises a first frame element and a second frame element; and the first frame element is configured to hingedly fold relative to the second frame element when in a stowed position.

13. The portable expandable shelter of claim 12, wherein the portable expandable shelter comprises one of a TRICON, a BICON, and a QUADCON.

14. The portable expandable shelter of claim 12, wherein the enclosure of the portable expandable shelter substantially conforms to a configuration other than an ISO configuration.

15. The portable expandable shelter of claim 12, wherein:

when the foldable frame is in the deployed position, the flexible cover substantially encloses a space at least partly defined by the foldable frame and the movable portion; and when the foldable frame is in the stowed position, a substantial portion of the flexible cover is stowed in the interior of the enclosure.

16. The portable expandable shelter of claim 12, wherein the foldable frame is configured to limit a range of motion of the movable portion.

17. The portable expandable shelter of claim 12, wherein the foldable frame supports and retains the movable portion from above when the movable portion is in the substantially horizontal position.

18. The portable expandable shelter of claim 12, further comprising a rigid door connected to a door frame that is rotatably connected to the movable portion, the door frame configured to be aligned with the doorway defined by the cover.

19. The portable expandable shelter of claim 12, wherein the foldable frame is rigid, such that when the foldable frame is in the deployed position, the foldable frame prevents the movable portion from moving toward the vertical position or to a position below the horizontal position.

20. A portable expandable shelter, comprising:

an enclosure that defines an interior and includes a top, a bottom, two ends and two sides, at least one of the sides or ends comprising a movable portion of the enclosure, the movable portion of the enclosure being movable between a substantially vertical position in which the interior has a volume and a substantially horizontal position in which the interior has an auxiliary volume;

a flexible cover connectible to the enclosure and defining and enclosing the auxiliary volume of the interior when the movable portion is in the substantially horizontal position; and a load bearing, foldable frame to which the flexible cover is connectible, the load bearing, foldable frame connectible at least indirectly to the movable portion and to the enclosure, and the load bearing, foldable frame being configured so that, when connected to the enclosure and the movable portion, the load bearing, foldable frame is movable between a stowed position and a deployed position in response to respective corresponding movements of the movable portion, and the load bearing, foldable frame supporting the movable portion from above when connected to the movable portion and the movable portion is in the substantially horizontal position; and wherein:

the load bearing, foldable frame provides rigid load bearing support to the movable portion in the substantially horizontal position;

the load bearing, foldable frame comprises a first frame element and a second frame element; and the first frame element hingedly couples to the second frame element.

21. The portable expandable shelter of claim 20, wherein the load bearing, foldable frame is rigid, such that when the load bearing, foldable frame is in the deployed position, the load bearing, foldable frame prevents the movable portion from moving toward the vertical position or to a position below the horizontal position.

22. A portable expandable shelter, comprising:

an enclosure that defines an interior volume and includes a top, a bottom, two ends and two sides, one of the ends being rotatably connected to the enclosure and movable between a substantially vertical position and a substantially horizontal position;

a flexible cover connected to the enclosure; and a foldable frame connected to the flexible cover, the foldable frame connected to the rotatable end and also connected to the enclosure at one or more locations, the foldable frame being configured to move between a stowed position and a deployed position in unison with respective corresponding movements of the rotatable end such that, as a result of movement of the rotatable end from the substantially vertical position to the substantially horizontal position, the foldable frame moves from the stowed position to the deployed position, wherein in the deployed position, the flexible cover forms a portion of the top, substantially enclosing an expansion to the interior volume collectively defined by the flexible cover and the rotatable end, and wherein when the rotatable end moves from the substantially horizontal position to the substantially vertical position, the foldable frame folds in unison with the rotatable end from the deployed position to the stowed position; and wherein:

the foldable frame provides load bearing support in the deployed position;

the foldable frame comprises a first frame element hingedly connected to a second frame element; and the first frame element folds relative to the second frame element when in the stowed position.

23. The portable expandable shelter of claim 22, further comprising a third frame element coupled to the first and second frame elements.

24. The portable expandable shelter of claim 23, wherein the third frame element extends away from and terminates at a higher elevation than the first and second frame elements.

25. The portable expandable shelter of claim 23, wherein the third frame element terminates at a higher elevation than the enclosure top.

* * * * *